US005524392A

United States Patent [19]

Franke et al.

[11] Patent Number: 5,524,392

[45] Date of Patent: Jun. 11, 1996

[54] AUTOMATED SEALING APPARATUS FOR A PACKAGING MACHINE

[75] Inventors: Rickard Franke, Dalby, Sweden; Per Brandstrom, Lake Zurich, Ill.; Yutaka Kaneko, Wheeling, Ill.; Bengt Andersson, Buffalo Grove, Ill.

[73] Assignee: Tetra Laval Holdings & Finance S.A., Pully, Switzerland

[21] Appl. No.: 316,109

[22] Filed: Sep. 30, 1994

[51] Int. Cl.[6] ..... E06B 3/00

[52] U.S. Cl. ..... 49/507; 49/360; 141/89

[58] Field of Search ..... 49/360, 477.1, 49/507; 141/89, 90, 91; 53/167

[56] References Cited

U.S. PATENT DOCUMENTS

| | | | |
|---|---|---|---|
| 1,004,623 | 10/1911 | Bodman . | |
| 1,835,676 | 12/1931 | Scholz et al. . | |
| 2,071,006 | 12/1937 | Urschel . | |
| 2,140,811 | 12/1938 | Poole . | |
| 2,141,618 | 12/1938 | Roge . | |
| 2,330,220 | 9/1943 | Kemper | 49/477.1 X |
| 2,838,077 | 6/1958 | Cooper . | |
| 3,087,517 | 4/1963 | Magnuson et al. . | |
| 3,195,585 | 7/1965 | Fechheimer . | |
| 3,302,333 | 2/1967 | Ganzinotti | 49/477.1 X |
| 3,339,785 | 9/1967 | Nugent | 49/477.1 X |
| 3,694,962 | 10/1972 | McDonald et al. | 49/477.1 |
| 3,716,083 | 2/1973 | Tuma et al. . | |
| 3,964,526 | 6/1976 | Sindermann . | |
| 4,213,795 | 7/1980 | Ernstsson et al. . | |
| 4,228,135 | 10/1980 | Wolff | 49/477.1 X |
| 4,335,075 | 6/1982 | Kackos | 49/477.1 X |
| 4,396,044 | 8/1983 | Ahlers . | |
| 4,446,674 | 5/1984 | Inada . | |
| 4,527,377 | 7/1985 | Hayashi et al. . | |
| 4,836,420 | 6/1989 | Kromrey . | |
| 4,905,744 | 3/1990 | Siegrest et al. . | |
| 4,964,444 | 10/1990 | Hanerus et al. . | |
| 4,967,813 | 11/1990 | Ponvianne et al. . | |
| 5,002,101 | 3/1991 | McLeod . | |
| 5,094,278 | 3/1992 | Arao et al. . | |
| 5,095,958 | 3/1992 | Tincati . | |
| 5,163,486 | 11/1992 | Rogers et al. . | |
| 5,176,189 | 6/1993 | Perchthaler et al. . | |
| 5,215,128 | 6/1993 | Neeser . | |
| 5,246,041 | 9/1993 | Wiese . | |
| 5,333,653 | 8/1994 | Rzesutock et al. . | |
| 5,348,058 | 9/1994 | Ruhl . | |

*Primary Examiner*—Philip C. Kannan

*Attorney, Agent, or Firm*—McAndrews, Held & Malloy Ltd.; Patrick N. Burkhart

[57] ABSTRACT

An automated sealing apparatus for sealing a packaging machine cleaning environment is set forth. The apparatus includes a retractable cover having first and second ends. The first and second ends of the retractable cover are disposed perpendicular to a direction of movement of the retractable cover. The apparatus further includes a first securing device disposed on the first end of the cover and a second securing device disposed on a top of the cover near the second end of the cover.

10 Claims, 3 Drawing Sheets

FIG. 4
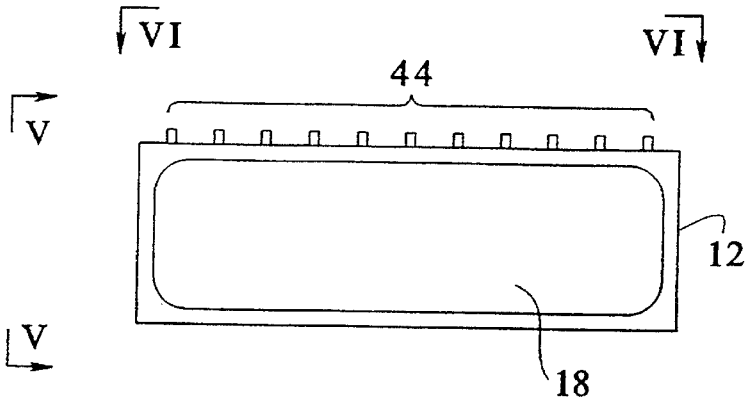
FIG. 5
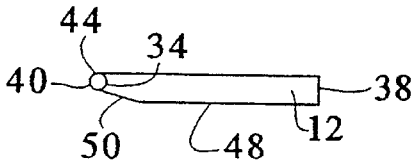
FIG. 6
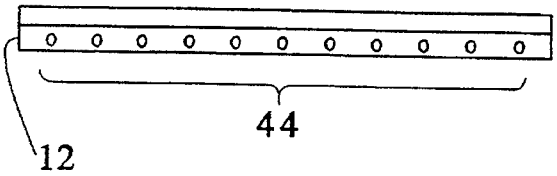
FIG. 7
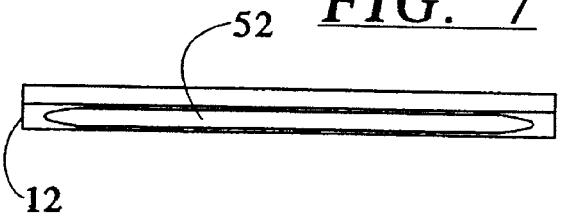
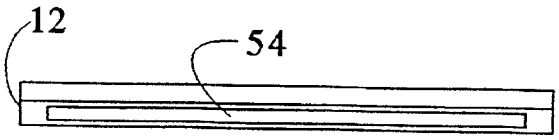
FIG. 8
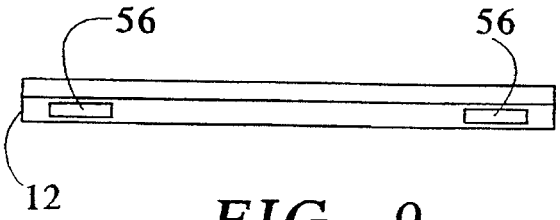
FIG. 9

AUTOMATED SEALING APPARATUS FOR A PACKAGING MACHINE

TECHNICAL FIELD

The present invention relates to an automated sealing apparatus for a packaging machine. More specifically, the present invention relates to an automated sealing apparatus for sealing a packaging machine cleaning environment.

BACKGROUND

Packaging machines are known that integrate into a single unit the various components necessary to form a container, fill the container with a liquid product, and seal the container. Such packaging machines typically feed carton blanks into the machine, seal the bottoms of the cartons, fill the cartons with a product dispensed from a product storage tank through a filling tube, seal the tops of the cartons, and off-load the filled cartons for shipping.

Where the liquid product dispensed into the cartons is a liquid foodstuff it may be necessary to maintain a generally sterile filling environment. The generally sterile filling environment must be maintained in the product storage tank, the filling tube, and in a region surrounding a terminus of the filling tube from which the product is dispensed. Further, the generally sterile filling environment must be maintained in an area below the terminus of the filling tube, extending as far below the terminus as is necessary to ensure that non-sterile air is effectively prevented from penetrating the area surrounding the terminus of the filling tube.

In order to prevent bacteria from forming in pans of the packaging machine that come into contact with certain liquid foodstuffs it is known to circulate a cleaning fluid through those parts. However, any liquid product remaining in the product tank at the end of the production cycle must be drained from the product tank before the cleaning cycle can begin. As the remaining liquid product is drained from the product tank it may become contaminated and unsuitable for reuse. It is therefore disposed of. The hygiene of the cleaning process itself has been problematic in the past.

In one known effort to improve the hygiene of the cleaning process, the need to dismantle and remove a product filling pipe from a packaging machine, in order to successfully clean the product filling pipe, is eliminated, as discussed in U.S. Pat. No. 4,964,444 to Hanerus et al. Hanerus et al. set forth a detachable lid. The detachable lid is fastened to a casing provided about a filling pipe of a packaging machine. Cleaning fluid is then cycled through the filling pipe, cleaning the interior of the filling pipe, and into the space surrounding the falling pipe, enclosed by the lid and the casing, cleaning the exterior of the pipe. The cleaning fluid then flows upwardly and out of the space surrounding the filling pipe through a branch pipe.

The foregoing lid itself requires manual installation, which is time-consuming and costly. In addition, remaining product cannot be cycled through the lid and remain contaminant free and reusable. Since packaging machines must be frequently cleaned, regularly disposing of remaining product is costly. The known lids fail to provide a solution to this problem.

SUMMARY OF THE INVENTION

An automated sealing apparatus for sealing a packaging machine cleaning environment is set forth. The apparatus includes a retractable cover having first and second ends.

The first and second ends of the retractable cover are disposed perpendicular to a direction of movement of the retractable cover. The apparatus further includes a first securing device disposed on the first end of the cover and a second securing device disposed on a top of the cover near the second end of the cover.

A method of sealing a packaging machine cleaning environment is also set forth. The method includes the following steps: moving a clean, retractable cover across an open end of a cleaning box; moving a first securing device, provided on a first end of the cover, into engagement with a first end of the cleaning box; and moving a second securing device, provided on a second end of the cover, into engagement with a second end of the cleaning box.

Other objects and advantages of the present invention will become apparent upon reference to the accompanying detailed description when taken in conjunction with the following drawings.

BRIEF DESCRIPTION OF THE DRAWINGS

FIG. 4 is a plan view of a closure member of the automated sealing device.

FIG. 5 is a side elevational view taken along lines V—V of FIG. 4.

FIG. 6 is a front elevational view taken along lines VI—VI of FIG. 4.

FIGS. 7–9 illustrate various other embodiments of the apparatus of FIG. 6.

DETAILED DESCRIPTION OF THE PREFERRED EMBODIMENT

Figure 1:
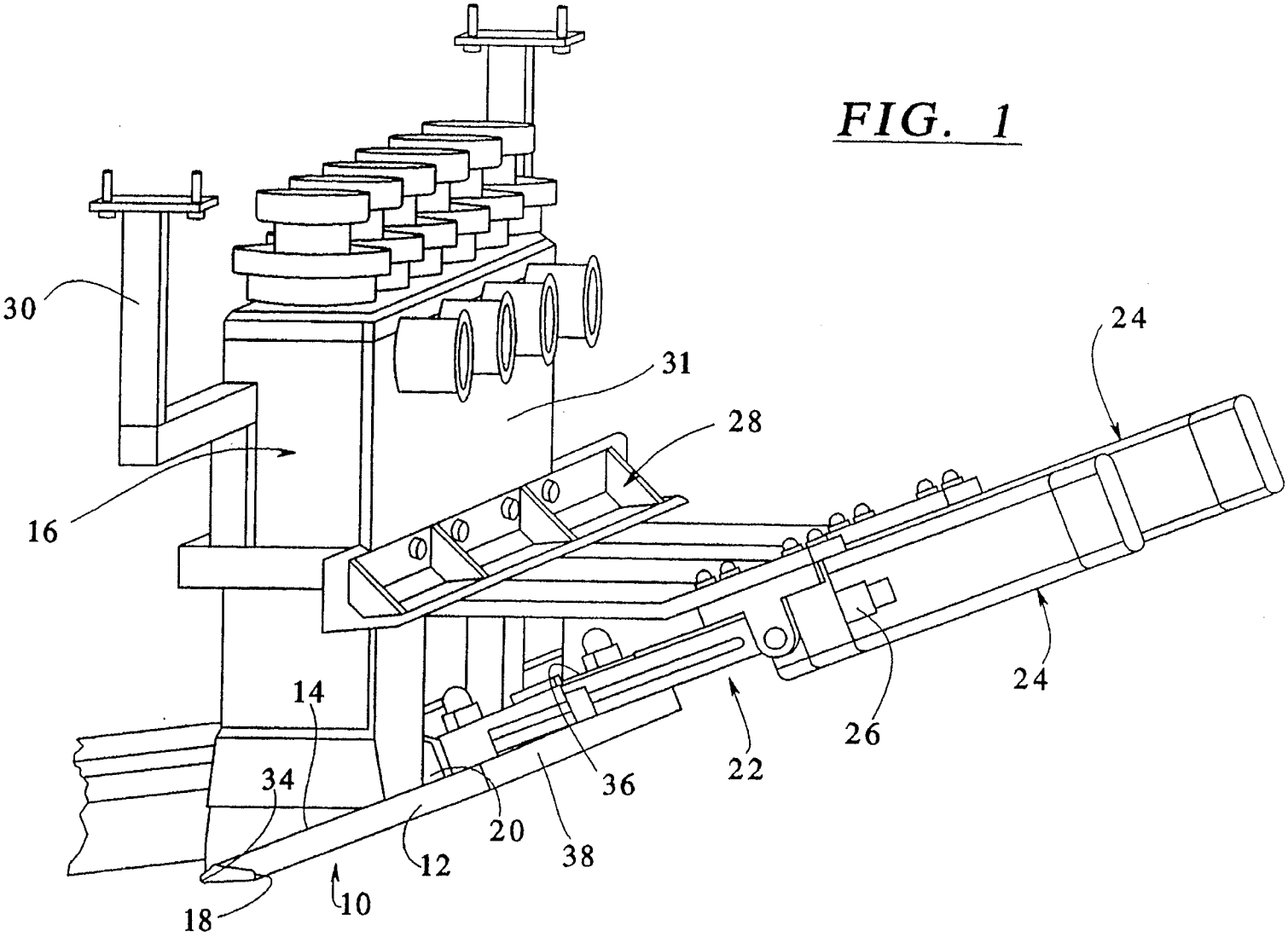
FIG. 1 is a perspective view of an automated sealing device wherein the sealing device is in a closed position and in sealing relationship with a cleaning box of a packaging machine.

FIG. 1 illustrates an automated sealing device, shown generally at 10. The automated sealing device 10 includes a retractable cover, or lid, 12. The retractable cover 12 is removably connected to an open end 14 of a cleaning box 16. The retractable cover 12 is maintained in a closed position and covers the open end 14 of the cleaning box 16, as illustrated in the FIG. 1, during both a product draining cycle and a cleaning cycle of a packaging machine.

The automated sealing device 10 further includes a suitable seal 18, such as a selectively actuable seal or an inflatable seal, provided on the retractable cover 12. The seal 18 is disposed in a suitable position on the retractable cover 12 such that a sealing engagement is achieved between the retractable cover 12 and the open end 14 of the cleaning box 16, such as on a top 20 of the retractable cover 12. One suitable position for the seal 18 on the retractable cover 12 is illustrated in further detail in FIGS. 2–4.

Figure 2:
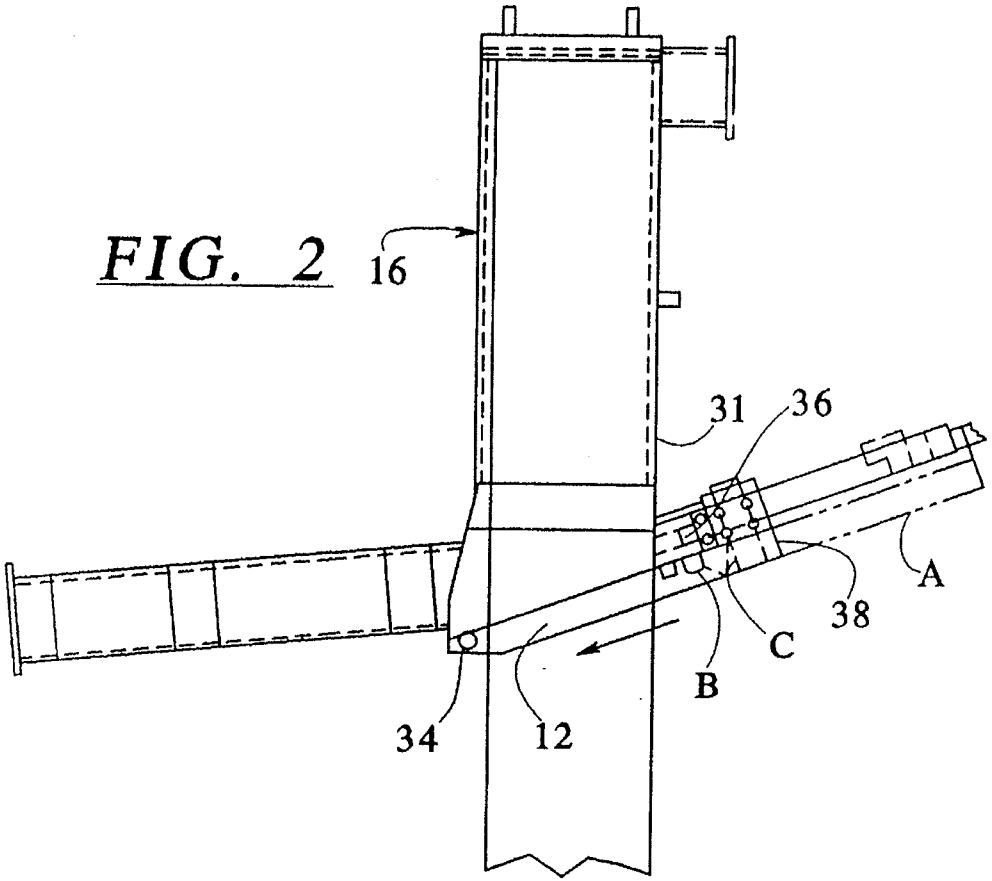
FIG. 2 is a side view of the automated sealing device of FIG. 1.

A retracting assembly, shown generally at 22, is provided for selectively moving the retractable cover 12 from an open position, illustrated by a broken line A in FIG. 2, to the closed position shown in FIG. 1. The retracting assembly 22 includes a suitable retracting device 24, such as a pair of pneumatic cylinders, connected to the retractable cover 12. A position sensor 26 is also provided. The position sensor 26 is connected to the retracting device 24 with a suitable bracket (not shown). The position sensor 26 detects the position of the retracting device 24, i.e., whether the retracting device 24 is in an extended or retracted position. The position sensor 26 ensures reliable positioning of the retractable cover 12 by the automated sealing device 10. The retracting device 24 and sensor 26 may be controlled and sensed by, for example, a control system such as the one set forth in U.S. Ser. No. 08/385,414 entitled "Control System for a Packaging Machine", filed on Sep. 28, 1994, incorporated herein by reference. Gimbals 27 prevent lock-up of the pneumatic cylinders 24 as the cover is driven form its first to its second position.

The retracting assembly 22 is secured to the packaging machine in a suitable manner, such that reliable positioning of the retractable cover 12 with respect to the open end 14 of the cleaning box 16 is achieved. For example, the retracting assembly 22 can be secured to the cleaning box 16 by a frame 28 connected to a bracket 30 provided on an exterior wall 31 of the cleaning box 16, as illustrated in FIG. 1.

The automated sealing device 10 also includes a first securing device 32, illustrated by a broken line B in FIG. 2 and shown in FIGS. 3–9, provided on a first end 34 of the retractable cover 12, and a second securing device 36 provided at a second end 38 of the retractable cover 12. The second securing device 36 is secured to the top 20 of the retractable cover 12 through an aperture illustrated by broken lines C in FIG. 2. The first and second ends 34, 38 of the retractable cover 12 are disposed perpendicular to a direction of movement, indicated by an arrow in FIG. 2, of the retractable cover 12.

When the retractable cover 12 is in an open position, illustrated by the broken line A in FIG. 2, an outermost end 40 of the first securing device 32 is maintained outside both a region surrounding and an area below a terminus of a filling tube from which product is dispensed. Therefore, where it is necessary to maintain a generally sterile filling environment in the packaging machine during a production cycle, the automated sealing device 10 remains outside the generally sterile filling environment. Further, both the retractable cover 12 and the seal 18 are easily cleanable. Thus, the automated sealing device 10 can be used to cover the open end 14 of the cleaning box 16 during a product draining cycle of the packaging machine, prior to the cleaning cycle, without contaminating the product as it is drained from the product tank, as is discussed more fully in U.S. Ser. No. 08/315,957, filed on even date herewith and incorporated by reference. Thus, a clean, retractable cover 12 is achieved in accordance with the principles discussed herein.

Figure 3:
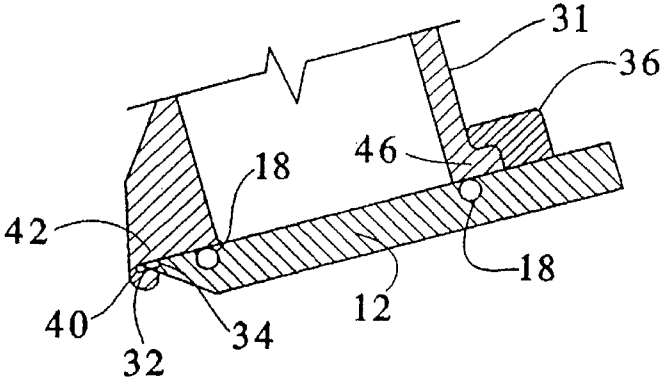
FIG. 3 is a detailed sectional view showing the engagement of the automated sealing device within the cleaning box of the packaging machine.

As illustrated in FIG. 3, a first end 42 of the cleaning box 16 is adapted to receive the first securing device 32. The first securing device 32 may include a series of pins 44 extending outwardly from the first end 34 of the retractable cover 12, as illustrated in FIGS. 4–6. In this case, the first end 42 of the cleaning box 16 includes a number of grooves (not shown), where each groove is adapted to receive a corresponding pin from the series of pins 44.

Alternative embodiments for the first securing device 32 can include, for example, an oval projection 52, illustrated in FIG. 7, a rectangular projection 54, illustrated in FIG. 8, and first and second rectangular projections 56, illustrated in FIG. 9. All suitable configurations for the first securing device 32 by which engagement of the first securing device 32 with the first end 42 of the cleaning box 16 is achieved, including the embodiments set forth in FIGS. 7–9, are contemplated to be within the scope of the principles discussed herein.

Further, the exterior wall 31 of the cleaning box 16 is adapted to receive the second securing device 36. The second securing device 36 may include a substantially rectangular projection having an L-shaped cross-section extending upwardly from the top 20 of the retractable cover 12, such as a lug, as illustrated in FIG. 3. In this case, the exterior wall 31 of the cleaning box 16 includes an L-shaped foot 46 adapted to receive the second securing device 36. All suitable configurations for the second securing device 36 by which engagement of the second securing device 36 with the first end 42 of the cleaning box 16 is achieved are contemplated to be within the scope of the principles discussed herein.

As the retracting assembly 22 is activated with the retractable cover 12 in an open position, the retractable cover 12 moves across the open end 14 of the cleaning box 16. The first and second securing devices 32, 36 then move into engagement with the first end 42 and the exterior wall 31 of the cleaning box 16, respectively, until the first and second securing devices 32, 36 fully engage the first end 42 and the exterior wall 31 of the cleaning box 16, respectively, and the retractable cover 12 is in the closed position, as illustrated in FIG. 3.

Once the retractable cover 12 is in the closed position, the seal 18 prevents liquid, flowing through the cleaning box 16, from leaking out of the open end 14 of the cleaning box 16. If the seal 18 is selectively actuable or inflatable, then the seal 18 is actuated or inflated once the retractable cover 12 is in the closed position, illustrated in FIG. 3.

As illustrated in FIG. 5, the retractable cover 12 has a generally rectangular configuration, and includes a bottom 48 having an inwardly angled section 50. All suitable configurations for the retractable cover 12 that achieve the sealing relationship between the retractable cover 12 and the open end 14 of the cleaning box 16 are contemplated to be within the scope of the principles discussed herein.

Although the present invention has been described with reference to specific embodiments, those of skill in the art will recognize that changes may be made thereto without departing from the scope and spirit of the invention as set forth in the appended claims.

We claim as our invention:

1. An apparatus for sealing an area about a dispensing end of a fill tube of a packaging machine, the apparatus comprising:

a cleaning box disposed to substantially surround a dispensing end of the fill tube, the cleaning box including a cleaning fluid inlet and a cleaning fluid outlet to facilitate a flow of cleaning fluid therethrough;

retractable cover means for covering an open end of the cleaning box during a cleaning cycle of the packaging machine in which the cleaning fluid is circulated through the cleaning box when the retractable cover means is in a first position, and for retracting to a second position in which the open end of the cleaning box is cleared by the retractable cover means during a filling cycle of the packaging machine, the fill tube being generally unobstructed by the retractable cover means when the retractable cover means is in the second position;

means for automatically moving the retractable cover means between the first and second positions; and first and second securing means, connected to first and second ends of the retractable cover means, respectively, for securing the retractable cover means to the cleaning box when the retractable cover means is in the first position, the first and second ends being disposed perpendicular to a direction of movement of the retractable cover means.

2. An apparatus according to claim 1, the retractable cover means further comprising a cover having a top portion disposed proximate the open end of the cleaning box, a bottom portion, and a seal provided along the top portion.

3. An apparatus according to claim 1 wherein the means for automatically retracting the retractable cover means comprises a pneumatic cylinder connected to the second securing means.

4. An apparatus according to claim 3 wherein the means for automatically moving the retractable cover means further comprises a position sensor connected to the pneumatic cylinder.

5. An apparatus according to claim 3, further comprising a frame connected to the pneumatic cylinder and to an exterior wall of the cleaning box.

6. An apparatus according to claim 1, the first securing means further comprising a series of pins extending outwardly from the first end of the retractable cover means.

7. An apparatus according to claim 1, the first securing means further comprising an oval projection extending outwardly from the first end of the retractable cover means.

8. An apparatus according to claim 1, the first securing means further comprising a rectangular projection extending outwardly from the first end of the retractable cover means.

9. An apparatus according to claim 1, the first securing means further comprising first and second rectangular projections extending outwardly from the first end of the retractable cover means.

10. An apparatus according to claim 1, the second securing means further comprising a substantially rectangular projection having an L-shaped cross-section extending upwardly from the second end of the retractable cover means.

* * * * *

UNITED STATES PATENT AND TRADEMARK OFFICE

CERTIFICATE OF CORRECTION

PATENT NO. : 5,524,392

DATED : June 11, 1996

INVENTOR(S) : Rickard Franke, et al

It is certified that error appears in the above-indentified patent and that said Letters Patent is hereby corrected as shown below:

Column 1, line 51, delete "falling" and insert --filling-- therefor.

Signed and Sealed this

Seventeenth Day of September, 1996

Bruce Lehman

*Attest:*

BRUCE LEHMAN

*Attesting Officer*

*Commissioner of Patents and Trademarks*